US006439113B1

(12) United States Patent
Gawlitta et al.

(10) Patent No.: US 6,439,113 B1
(45) Date of Patent: Aug. 27, 2002

(54) METHOD OF PRESSING MATS INTO THE PRODUCTION OF PRESSED BOARD

(75) Inventors: Werner Gawlitta, Tegelen (NL); Lothar Sebastian, Moers (DE); Klaus Schürmann, Jüchen (DE); Horst Weiss, Krefeld (DE)

(73) Assignee: G. Siempelkamp GmbH, Krefeld (DE)

( * ) Notice: Subject to any disclaimer, the term of this patent is extended or adjusted under 35 U.S.C. 154(b) by 0 days.

(21) Appl. No.: 09/556,730

(22) Filed: Apr. 21, 2000

(30) Foreign Application Priority Data

Apr. 23, 1999 (DE) ..... 199 18 492

(51) Int. Cl.[7] ..... B30B 15/34; B30B 5/04

(52) U.S. Cl. ..... 100/38; 100/152; 100/154; 100/41

(58) Field of Search ..... 100/38, 151, 152, 100/154, 41; 156/555, 583.3, 583.5; 92/118

(56) References Cited

U.S. PATENT DOCUMENTS 4,956,140 A * 9/1990 Rolles et al. ..... 425/384
5,112,209 A * 5/1992 Ahrweiler et al. ..... 100/152
5,121,683 A * 6/1992 Bielfeldt ..... 100/38
5,433,145 A * 7/1995 Bielfedlt ..... 100/41
5,454,304 A * 10/1995 Bielfeldt ..... 100/154
5,658,407 A * 8/1997 Thorbjornsson ..... 156/583.5
5,775,214 A * 7/1998 Bielfeldt et al. ..... 100/154
5,875,708 A * 3/1999 Bielfeldt ..... 100/41
6,041,700 A * 3/2000 Sebastian et al. ..... 100/154
6,098,532 A * 8/2000 Sebastian et al. ..... 100/41
6,142,068 A * 11/2000 Sebastian et al. ..... 100/154

FOREIGN PATENT DOCUMENTS

DE 197 40 325 5/1998

* cited by examiner

*Primary Examiner*—Stephen F. Gerrity
*Assistant Examiner*—Louis Huynh
(74) *Attorney, Agent, or Firm*—Herbert Dubno

(57) ABSTRACT

A method for producing pressed board deforms the mat with compression and decompression between heated plates upstream of the platens.

6 Claims, 3 Drawing Sheets

METHOD OF PRESSING MATS INTO THE PRODUCTION OF PRESSED BOARD

FIELD OF THE INVENTION

The present invention relates to a method of pressing mats of a compressible material, usually a material made from wood and containing cellulosic fibers or particles, with or without a binder, and, more particularly, to a method of operating a continuous press for the production of pressed board and, of course, to a continuous press for the production of pressed board operated by the method of the invention.

BACKGROUND OF THE INVENTION

Continuous presses for the production of pressed board generally comprise a pair of belts, usually of steel, passing a mat of a material which can be consolidated into pressed board between upper and lower press platens mounted respectively on the upper and lower parts of the continuous press.

Such presses are used in the production of pressed board from wood particles or fibers, more generally cellulosic particles and fibers, with or without binders which may be thermally activated and for that purpose, the press platens are usually heated to a temperature such that, upon compression of the mass to a nominal thickness, namely, a standard thickness of the finished board, the combination of heat and pressure consolidates the mass to a rigid board which can then be trimmed to standard length and width dimensions outside the press. The boards which may be produced in this manner are known generically as particle board and can include fiber board, chip board and the like.

The press can have at an inlet side, a pair of bendable plates, referred to herein as inlet plates, which converge toward the gap between the platens and define a mouth for the press. These plates may have high bending elasticity, i.e. tend to restore their original shape when subjected to bending at high pressures, e.g. from a plurality of piston and cylinder units mounted on the upper and lower parts of the press and bearing upon the upper and lower plate. These piston and cylinder units are usually hydraulically operated to vary the shape of the mouth.

The plates themselves may be heated and between the plates and platens and the steel belts, roller rods may be provided to reduce the friction between the belts and the surfaces along which the belts are guided of the plates and platens.

The piston and cylinder units can be connected to a hydraulic controller or a hydraulic regulator for the system, operated by a computer or the like. Usually this ability to modify the inlet contour of the inlet mouth of the press serves to allow a steplessly-continuous compression of the mat and is in the form of a continuous bend of the inlet plates producing a monotonic convergence between them (see German patent document 197 40 325).

OBJECTS OF THE INVENTION

It is the principal object of the present invention to provide an improved method of pressing compressible mats of a material adapted to form a press board under heat and pressure whereby the production of pressed board and, in particular, the compaction of the mass prior to entry between the press platen is optimized.

Another object of this invention is to provide an improved method of operating a continuous press of the type described.

It is also an object of the invention to provide an improved continuous press for the production of pressed board whereby drawbacks of earlier systems are obviated.

SUMMARY OF THE INVENTION

These objects are attained, in accordance with the invention by automatically and at the beginning of the inlet phase at the inlet portion of the mouth subjecting the mat to an accelerated heat transfer by rapidly and strongly compressing the mat utilizing the bendable plates and the aforementioned hydraulic units.

More particularly, the method of pressing a compressible mat for producing pressed board in a continuous press can comprise controlling the gap between the upper and lower press plates by operation of the piston and cylinder units to rapidly and strongly compress the mat and thereby accelerate heat transfer to the compressed mass by the heated plates before passage of the mat between the platens.

The method is also a method of operating the continuous press which comprises an upper press part and a lower press part, a heated lower platen on the lower press part, a heated upper platen on the upper press part defining with the lower platen a pressing space having a width for producing a pressed board of a nominal thickness, a pair of belts displaceable along the platens for conveying a mat between the plates and a pressed board out of the space, an upper bendable inlet plate and a lower bendable inlet plate extending from the upper and lower platen toward an inlet side of the press and defining between them a variable contour mouth through which the mat enters the press, and a plurality of piston and cylinder units acting on one of the plates and braced upon the respective press part for varying the contour of a gap between the plates, the method comprising controlling the unit so that a respective mat at a beginning of an inlet phase is rapidly and strongly compressed at an inlet region of the mouth with accelerated heat transfer to the mat.

The continuous press itself can comprise a continuous press for the producing of mats of a compressible material for the production of pressed board, the press comprising an upper press part and a lower press part, a heated lower platen on the lower press part, a heated upper platen on the upper press part defining between then a pressing space having a width for producing a pressed board of a nominal thickness, a pair of belts displaceable along the platens for conveying a mat between the plates and a pressed board out of the space, an upper bendable inlet plate and a lower bendable inlet plate extending from the upper and lower platen toward an inlet side of the press and defining between them a variable contour mouth through which the mat enters the press, and a plurality of piston and cylinder units acting on one of the plates and braced upon the respective press part for varying the contour of a gap between the plates, and automatic control means connected to the units for controlling the units whereby controlling the unit so that a respective mat at a beginning of an inlet phase is rapidly and strongly compressed at an inlet region of the mouth with accelerated heat transfer to the mat.

The invention is based upon the fact that the flexible but highly elastic and shape-restorative configuration of the inlet plates of the mouth enables at least one of these plates to be deformed toward the other of these plates to form a compression zone at the inlet side of these plates whereby the heated plates rapidly transfer heat to the high-density mass formed by the compression.

With the system of the invention, depending upon the characteristics of the compressible material, the mat thickness, the liquid density of the material forming the mat and the other pressing properties thereof, the compression of the mats can be controlled in the longitudinal direction and as the mat passes through the mouth between the plates because the spacing between the plates is variable in the direction of advance in the material.

With the system of the invention, it is no longer necessary to have the minimum width of the gap between the plates immediately at the point at which the plates are joined to the press platens. Rather the minimum spacing between the plates can be at another location substantially upstream therefrom and toward the inlet side of the mouth. In fact, the location of the minimum spacing between the plates can be varied to lie anywhere along the length of the mouth. The result is that the position of the minimum spacing and thus highest degree of compression of the mass can be located at an optimum position depending upon the parameter mentioned earlier of the compressible mass to obtain a more effective compaction of and heat transfer to the material of the mats and a more uniform and higher quality product.

The earlier compaction of the mass of compressible material not only enables higher densities to be achieved than have been attainable heretofore but also accelerates heat transfer to the material so that the quality of the product is significantly improved.

It has been found, for example, that the compressive properties of such mats vary with increasing temperature significantly. For example, in the case of a cold compaction, i.e. compaction well below the normal operating temperature of the platens, a compressive force 700 N/cm$^2$ may be required to obtain a density of say 860 kg per m$^3$. This force can drop below 100 N/cm$^2$ for the same density of the finished product as the temperature of the platens increases. When the mat material is strongly heated by compression between the inlet plates well upstream of the platens within the mouth of the press and toward the inlet side of the mouth, an especially efficient heat transfer to the articles and/or fibers is obtained that a substantially reduced temperature can be maintained within the press without any detrimental effect on the density of the product obtained.

According to a preferred feature of the invention with independent significance, the mass of compressible material, referred to herein as the mat is compressed to a nominal thickness, i.e. to that pressed board to be made, in the inlet portion or mouth and between the two plates which extend from the platens to define the mouth and, after a predetermined compression phase or duration of compression, is passed between portions of the plate spaced at a greater distance for decompression. The widening of the gap between the two plates downstream of the narrowest portion of this gap results in a decompression of the material of the mat. As a result, the mat is subjected to a rapid compression in which the vapor pressure is reduced and the heating of the material of the mat is greatly accelerated so that there is practically an instantaneous or sudden heating of the mat layers through to the deeper most layers. The compaction to nominal thickness results in a mat which is more coherent and capable of being transported into and through the press more effectively than is the case with previous pressing techniques and apparatus.

A reference to a compact mass of the material of the mat is intended to refer to densities which exceed 1000 kg/m$^3$ and are up to 1350 kg/m$^3$. Apart from greater ease in handling the mat, there is a significant improvement in heat transfer to the material over the whole length of its path in the press and from the plates and platens to the material.

Aside from the better heat transfer, the mat provides a greater resistance to the forces applied by the travelling rollers or rods which are interposed between the belts and the platens so that the wave (hertzian) effect in pressing the mat and resulting from the presence of the rods or rollers is greatly improved. The rods are thus capable of delivering the requisite amount of heat to the mat in a much shorter time or much more rapidly than has hitherto been the case. For example, whereas in the earlier presses using steel belts with circulating rod systems, about 40 kw/m$^2$ was about the maximum energy transport value, with the invention, up to 100 kw/m$^2$ can be delivered. The compaction of the upper and lower layers of the mat and the heating of the material of the mat through its thickness can thus be accomplished in a much shorter time than has been customarily the case. Moreover, since the heating is greatly accelerated, a smaller specific press pressure is required. Since the compacted outer layers of the mat receive sufficient heat in a short time to harden, the rapid hardening results in outer layers of higher density. The heat/time factor is greatly reduced because of the more rapid compaction so that the mats and the board formed therefrom can pass through the press more quickly, thereby increasing the press capacity.

The heat/time factor is lower, with the system of the invention. The lighter the particle board made so that the system of the invention has a double effect.

Since the press pressure at the mouth of the press remains for a sufficient duration to initially harden the upper and lower layers of the mat and thereby allow the mat to provide a counterpressure, the press pressure within the mouth and between the inlet plates of high bending elasticity can be suddenly reduced by the piston and cylinder units acting on these plates to generate a "drawing" action on the mats. Especially with thin board, whose thicknesses can range from 2 mm to 12 mm and is preferably between 5 mm and 9 mm, the heat transferred to the board during that initial compaction is sufficient to heat the mat through a significant part thereof. So that the shape of the density profile in the region of the middle layer or portion of the mat can be positively influenced, it is possible to provide lower densities of say 400 to 700 kg/m$^3$ and preferably 500 to 600 kg/m$^3$ in these interior regions utilizing the heating between the platens and the lower press pressures generated between the platens with the system of the invention.

As a whole, therefore, the press process according to the invention and the product properties are enhanced. For example, the amount of grinding and sanding to which the board must be subject later is reduced which means that there is a net reduction in the amount of material used per cubic meter of boards produced and a reduced sanding cost.

The smaller board thickness which the press must produce can be made with a shorter heating duration and thus a significant increase in press capacity.

Furthermore, there is, with the invention, a shorter interval between the mat contact in the mouth of the press and the platens and the distance to maximum press pressure can be freely chosen. This improves the versatility of the process and allows better control of a number of factors, for example, the initial compression, the air inclusion in the pressed product, heat/time factors for various board thicknesses and maximum capacity utilization over a wide range of board thicknesses.

According to another feature of the invention, the platen region of the press serves in part as a cooling stretch for the board. According to this aspect of the invention, the temperature to which the board is heated by the platens is say 80° C. to 160° C. lower than the temperature of the plates and applied by the plates to the compressible material of the mat. This insures that the mat will be heated up over an especially short region and only subsequently, when heating to a lower temperature is required, must the heating be effected through the roller rods, steel belts and platens. The mechanical elements are subjected to the highest temperature for a shorter period of time than has hitherto been the case and with the stepped down heating of the boards, the rods themselves may have to reach the highest temperature only along their peripheries.

With the system of the invention, therefore, thinner steel belts, smaller roller diameters and even hollow rods are conceivable.

Still another advantage is that a certain degree of cooling of the mat can be accomplished where the surfaces of the boards are fully supported and this allows especially thin boards, e.g. for flooring, to be fabricated very inexpensively. A higher press speed can be used than has hitherto been the case and the increased capacity can result in reduction of production costs while nevertheless yielding higher quality of chip board, fiberboard and other particle boards of wood and cellulosic material.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
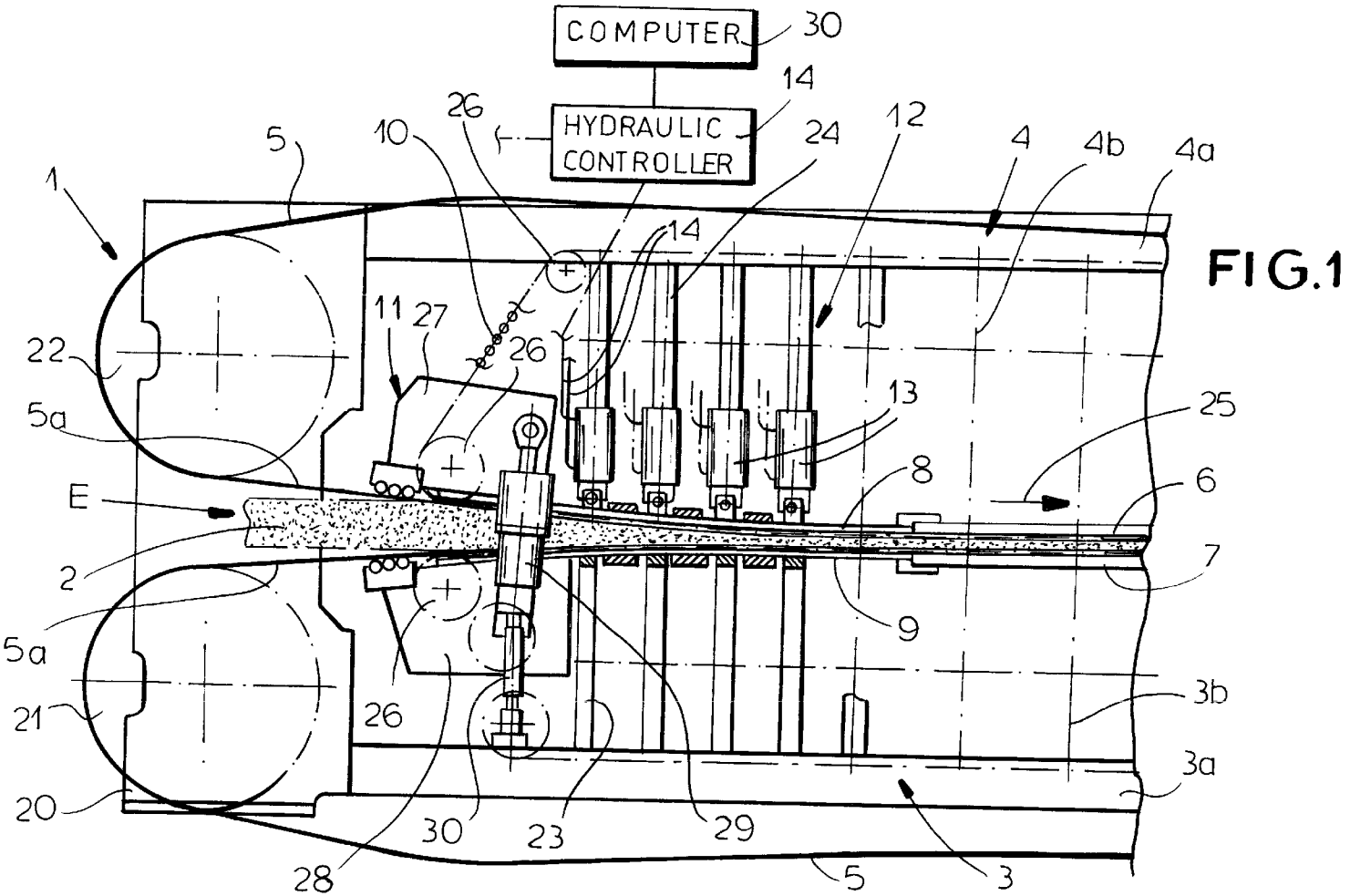
FIG. 1 is a diagrammatic side elevation view of the inlet part of a continuous press used for carrying out the method of the present invention.

FIG. 1 of the drawing shows a continuous press 1 for the production of press board from mats 2 of cellulosic fibers, chips or particles, especially wood chips, sawdust or wood particles, with or without a thermally activatable binder like a phenol-formaldehyde resin for the production of chip board, fiber board and the like. The press has a lower press part 3 comprised of a beam 3*a* and frame members 3*b* supporting the lower press platen 7. The upper press part 4 has a beam 4*a* supporting frame members 4*b* carrying the upper press platen 6. Both press platens are heated in the usual manner and the upper press platen 6 can be mounted on hydraulic cylinders so as to be movable toward the lower press platen 7 to establish the gap between them. The beams 3*a* and 4*a* extend beyond the press platens 6 and 7 in the inlet region to provide a support 20 for a pair of drums 21 and 22 around which endless steel belts 5 pass. The steel belts have strips 5*a* converging toward one another to form a mouth through which the mat 2 passes into the press. The mouth has been represented at E.

In addition, on the beams 3*a* and 4*a*, supports 23 and 24 are provided. The supports 23 form a fixed support for a lower intake plate 9 which extends from the lower platen 7 to the mouth E and over which the belts 5 are guided. The supports 24 carry piston and cylinder arrangements 13 which are braced against the upper plate 8 and are spaced apart in the direction of travel of the mat (arrow 25).

The plates 8 and 9 are thus cantilevered from the platens 6 and 7 and extend toward the intake side to assist in defining the mouth E. The plates 8 and 9 are heated and, in particularly, are heated to a temperature of 80° C. to 160° C. above the temperature of the platens 6 and 7.

Between the belts 5 and the platens 6, 7 and the plates 8, 9, are roller rods 10 which are chained together and pass over rollers 26 mounted on the upper and lower press parts and upon a device 11 for adjusting the width of the mouth. This device 11 can comprise a pair of jaws 27, 28 which are connected together by a hydraulic piston and cylinder arrangement 29, the latter being linked at 30 to the beam 3*a*.

Figure 2:
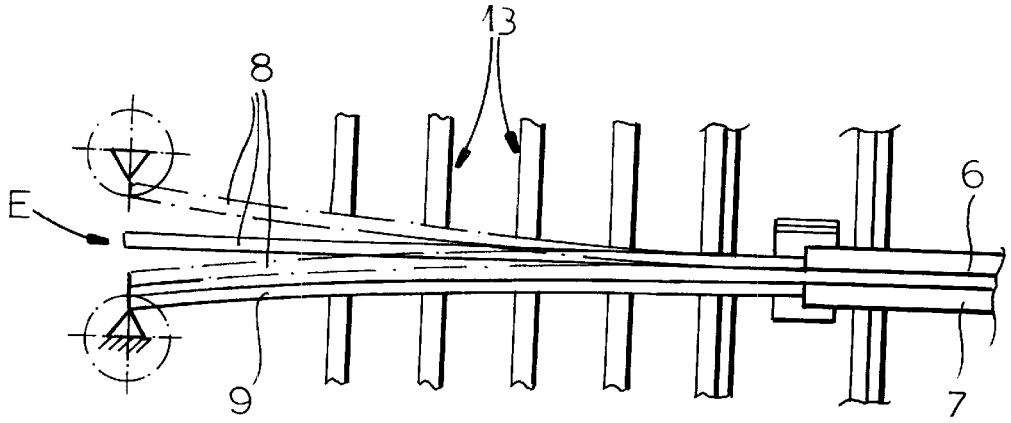
FIG. 2 is a schematic side elevational view showing different positions of the inlet plates (upwardly bent, straight, downwardly bent) with a fixed lower inlet plate with a predetermined bending radius.

The device 11 and the assembly 12 of double acting differential cylinders 13 serve to adjust the contour of the mouth E as will be described in connection with FIGS. 2 and 3.

The differential cylinders can be connected to a computer operated hydraulic controller 14, the computer being represented at 30 in FIG. 1. The result is a full flexibility high bending elasticity inlet or mouth for the press. As can be seen from FIG. 2, for example, either or both of the high bending elasticity plates 8, 9 may be deformed by the differential cylinders 13. In FIG. 2, for example, the lower plate 9 has a fixed radius curved contour while the upper plate 8 can be deformed so that it lies straight or is bent upwardly or downwardly as shown in dot dash lines to vary the contour of the mouth E.

Figure 3:
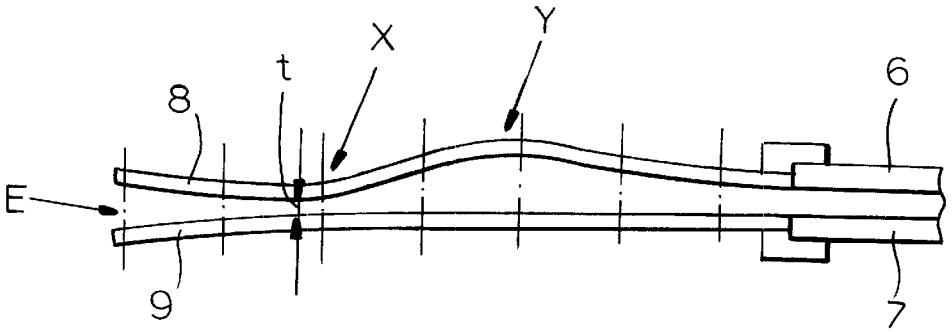
FIG. 3 is a view similar to FIG. 2 showing a special configuration of the intake mouth in which the mat is compressed to its nominal thickness and then is subjected to decompression.
Figure 4:
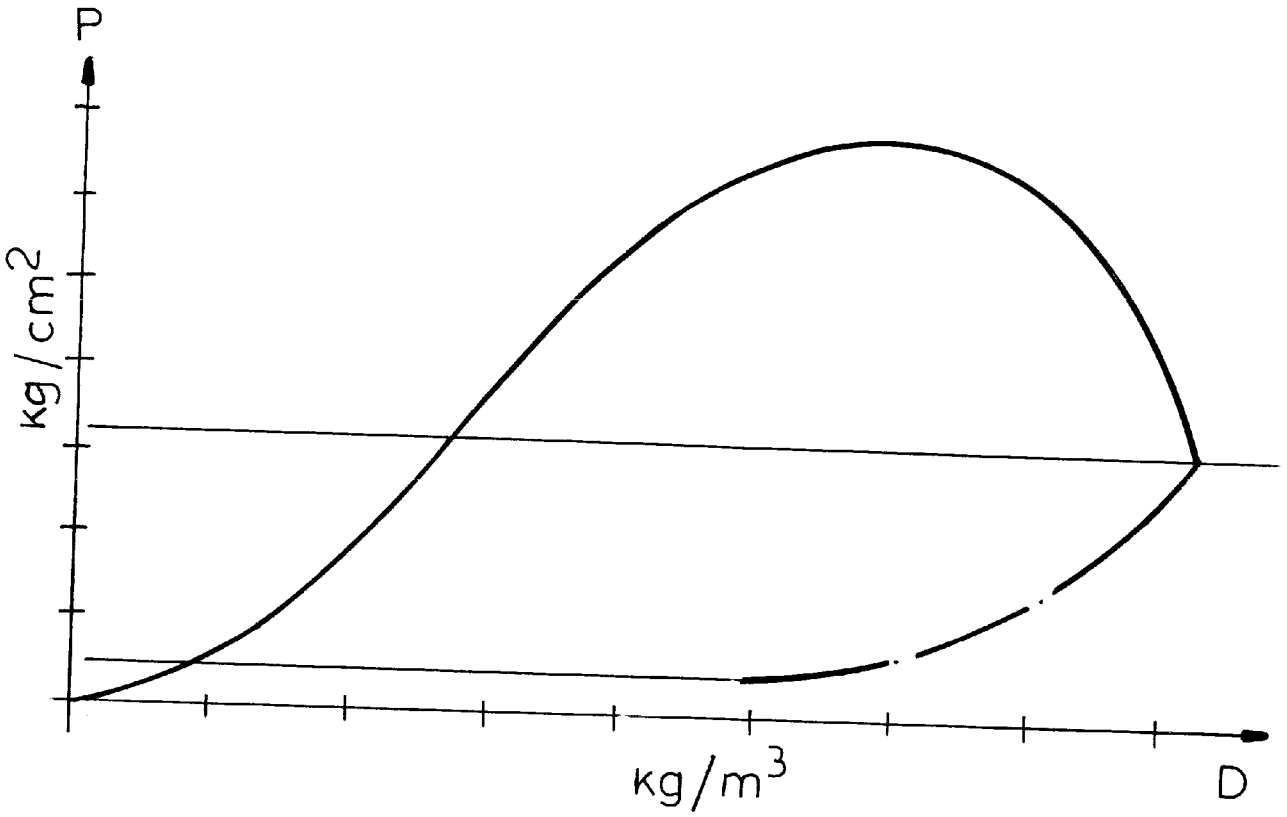
FIG. 4 is a diagram in which pressure is plotted along the ordinate against density along the abscissa of a divisional pressure/density diagram for a continuous press (solid line) and for compression in accordance with the invention (dot-dash line in the intake mouth, both leading to the same mat density.

From FIG. 3, it will be apparent that the plates can be deformed so that the mat is strongly compressed to the nominal thickness t of the board to be produced at a location X close to the inlet side of the mouth for especially rapid heat transfer to the mat. The mat can then be subjected to a decompression phase at Y. Since the platens 6 and 7 are about 80° to 160° C. lower in temperature than the inlet plates 8 and 9, while continuing to press the mat with heat and pressure, they act in part as a cooling zone. The temperature may be stepped down from region to region along the platens 6, 7 as well. The result, as shown in FIG. 4 is that for a certain mat density D of about 860 kg/m$^3$ requires only a press pressure of 100 N/cm$^2$ whereas the conventional process requires about 700 N/cm$^2$. Instead of differential cylinders, other devices can be used for setting the contour of the mouth.

We claim:

1. A method of pressing a compressible mat for producing pressed board in a continuous press wherein the continuous press comprises a pair of elastic bendable heated inlet plates between an upper and a lower press palten, a pair of belts displaceable along said plates, the plates and the belts forming an intake mouth having a contour controllable by a plurality of piston and cylinder units positioned to act on at least one of said plates for altering a configuration of a gap between said plates, said method comprising;

feeding a compressible mat through said intake mouth and entraining said mat between said platens with said belt;

controlling said gap with said piston and cylinder units at an inlet phase of the respective mat and at an inlet portion of said mouth to rapidly and strongly compress said mat and accelerate heat transfer to said mat to a temperature prior to passage of said mat between said platens; and compressing the mat a nominal thickness at said inlet portion for a predetermined compression phase and thereafter expanding the mat by enlarging a portion of said gap to produce a decompression in the mat before said mat passes between the platens.

2. The method defined in claim 1 wherein said mat is heated between said platens to a temperature which is lower than the temperature of said mat heated by said plates.

3. The method defined in claim 2 wherein said mat is heated by said platens to a temperature of 80° to 160° C. less than the temperature of said mat heated by said plates.

4. A method of operating a continuous press for the producing of mats of a compressible material for the production of pressed board, said press comprising an upper press part and a lower press part, a heated lower platen on said lower press part, a heated upper platen on said upper press part defining between them a pressing space having a width for producing a pressed board of a nominal thickness, a pair of belts displaceable along said platens for conveying a mat between said plates and a pressed board out of said space, an upper heated bendable inlet plate and a lower heated bendable inlet plate extending from said upper and lower platen toward an inlet side of the press and defining between them a variable contour mouth through which said mat enters the press, and a plurality of piston and cylinder units acting on one of said plates and braced upon the respective press part for varying the contour of a gap between said plates, said method comprising controlling said piston and cylinder units so that a respective mat at a beginning of an inlet phase is rapidly and strongly compressed at an inlet region of said mouth, said units being automatically controlled so that said mat is initially compressed to said nominal thickness and after a predetermined compression phase is expanded by widening a potion of said gap between said plates to generate a decompression in said mat.

5. The method defined in claim 4 wherein said platens are heated to a temperature less than a temperature of said plates.

6. The method defined in claim 5 wherein said platens are heated to a temperature of 80 to 160° C. less than the temperature of said plates.

* * * * *